US008458930B2

(12) United States Patent
Ha

(10) Patent No.: US 8,458,930 B2
(45) Date of Patent: Jun. 11, 2013

(54) FOOTWEAR OUTSOLE

(75) Inventor: Ki-Ho Ha, Busan (KR)

(73) Assignee: Shin Kyung Co., Ltd., Gimhae-si, Gyeongsangnam-do (KR)

( * ) Notice: Subject to any disclaimer, the term of this patent is extended or adjusted under 35 U.S.C. 154(b) by 688 days.

(21) Appl. No.: 12/376,967

(22) PCT Filed: Jul. 31, 2007

(86) PCT No.: PCT/KR2007/003684

§ 371 (c)(1),
(2), (4) Date: May 24, 2010

(87) PCT Pub. No.: WO2008/018713

PCT Pub. Date: Feb. 14, 2008

(65) Prior Publication Data

US 2010/0275460 A1 Nov. 4, 2010

(30) Foreign Application Priority Data

Aug. 11, 2006 (KR) ..... 20-2006-0021689 U
Jul. 12, 2007 (KR) ..... 10-2007-0069948

(51) Int. Cl.
*A43B 7/22* (2006.01)
*A61F 5/14* (2006.01)

(52) U.S. Cl.
USPC ..... 36/150; 36/155; 36/157; 36/97; 36/91

(58) Field of Classification Search
USPC ..... 36/150, 155–157, 160, 97, 91, 88, 36/34 R, 36 R, 36 C, 42
See application file for complete search history.

(56) References Cited

U.S. PATENT DOCUMENTS

| | | | | | |
|---|---|---|---|---|---|
| 1,242,317 | A | * | 10/1917 | Boyajian | 36/156 |
| 1,558,192 | A | * | 10/1925 | Lindgren | 36/156 |
| 2,295,364 | A | * | 9/1942 | Skorepa | 36/156 |
| 4,166,329 | A | | 9/1979 | Herbig | |
| 4,316,333 | A | * | 2/1982 | Rothschild | 36/50.1 |
| 4,417,408 | A | * | 11/1983 | Metro | 36/36 R |
| 4,429,474 | A | * | 2/1984 | Metro | 36/36 A |
| 4,610,100 | A | * | 9/1986 | Rhodes | 36/42 |
| 4,841,648 | A | * | 6/1989 | Shaffer et al. | 36/43 |
| 5,456,026 | A | * | 10/1995 | Lewis | 36/42 |
| 5,519,950 | A | * | 5/1996 | Wang | 36/42 |
| 6,138,385 | A | * | 10/2000 | Jungkind et al. | 36/97 |
| 6,609,314 | B1 | * | 8/2003 | Dubner | 36/156 |
| 6,711,835 | B1 | * | 3/2004 | Militello | 36/42 |
| 7,055,268 | B2 | * | 6/2006 | Ha | 36/97 |

(Continued)

FOREIGN PATENT DOCUMENTS

| | | |
|---|---|---|
| KR | 20-1990-0018154 | 11/1990 |
| KR | 10-2002-0060966 | 7/2002 |
| KR | 20-20040013563 | 5/2004 |

*Primary Examiner* — Marie Patterson
(74) *Attorney, Agent, or Firm* — Christopher Paul Mitchell

(57) ABSTRACT

A footwear outsole includes an arch member shiftably assembled on a central part of an upper surface of a outsole body in a longitudinal direction and a rear heel shiftably assembled on a rear part of a lower surface of the outsole body in a longitudinal direction. The footwear outsole has an advantage in that the footwear outsole can not only prevent the foot from becoming flat, but can also minimize shock on the sole of the foot, and reduce foot fatigue Therefore, the comfortable sensation can be maintained, and an effect of stretching are maximized so as to make the blood smoothly circulate and acupressure the acupunctural K1 region.

9 Claims, 4 Drawing Sheets

U.S. PATENT DOCUMENTS

2003/0163934 A1* 9/2003 Wallin et al. ..... 36/34 R
2003/0188460 A1* 10/2003 Dubner ..... 36/156
2004/0064974 A1* 4/2004 Schuster ..... 36/91
2005/0060913 A1* 3/2005 Chil et al. ..... 36/97
2005/0066548 A1* 3/2005 Chil et al. ..... 36/97
2005/0115114 A1* 6/2005 Miller et al. ..... 36/97

* cited by examiner

FOOTWEAR OUTSOLE

RELATED APPLICATIONS

This application is a 371 application of International Application No. PCT/KR2007/003684, filed Jul. 31, 2007, which in turn claims priority from Korean Patent Application Nos. 20-2006-0021689, filed Aug. 11, 2006, and 10-2007-0069948, filed Jul. 12, 2007, all of which are incorporated herein by reference.

TECHNICAL FIELD

The present invention relates to a footwear outsole, more particularly to a footwear outsole in which a shiftable arch member is mounted on a central part of an upper surface of a footwear outsole so that a user uses the arch member through shifting depending on the position of the arch of a user's foot. Therefore, the outsole and the arch member can be in close contact with and support an entire part of the user's foot so that it is easy to absorb shock, and so that it can maintain comfortable wearing sensation, even though a user puts on footwear for many hours. Further, a rear heel is shiftably assembled in a rear part of a lower surface of the outsole in a longitudinal direction of the outsole, such that it can correct the erect posture of a human so as to bring an effect of spine correction, and improve the corresponding function of the stature.

BACKGROUND ART

As various new materials have been developed together with scientific technology development, footwear has been rapidly developed ever since a human can walk, so that nowadays, the footwear for various usages suitable for diverse activities, such as walking, climbing, physical correction, specific sports, or the like, have been made.

Especially the footwear for exercise, as the importance of health has been in the spotlight, has made rapid progress, and footwear having new materials and structures have been also continuously developed. Therefore, considering an aspect of physical health, the priority to be solved is better air permeability and cushioning of the footwear.

In order to achieve a fundamental object of surrounding and protecting the foot and allowing a human to act, all kinds of footwear rather than slippers have a formation that their inner surfaces are almost covered up except for a certain upper part through which a human can put on and off the footwear. Therefore, the air permeability aspect of the footwear is basically inevitable due to a characteristic of the footwear. However, various materials having superior air permeability and diverse air permeable structures suitable for footwear have been developed, so that an air permeability problem has been gradually improved.

More important in the physical health aspect than air permeability is cushioning. If the cushioning of the footwear is not good, not only does a human easily feel foot fatigue, but also it may have bad influence on the body because shock caused by contact between the footwear outsole and the ground is transferred to the brain through the spine. Therefore, the footwear should have sufficient cushioning.

The part to which the cushioning is applied is the footwear outsole, of which the problem is considerably solved through the development of the various materials having superior shock absorption. However, it cannot solve all problems of the cushioning only by means of the materials having superior cushioning.

That is, a conventional outsole of footwear is almost shaped like a plane. Therefore, the conventional footwear outsole not only cannot totally relieve shock on the sole of the foot because the footwear outsole is not in close contact with the sole of a foot having big and small curves, specifically, the arch of the foot, but also occurs a problem of making the sole of the foot flat when wearing the footwear for a long time period.

Further, if the footwear cannot stably support the arch of a central part of a human body, and make the arch to be in contact with the footwear outsole, the center of the foot is out of the center so that the pelvis gets twisted and serious problems may occur in the musculoskeletal system.

Therefore, in order to improve the cushioning while more stably supporting the arch of the sole of the foot, footwear having a convex part upwardly protruding from an upper surface of the outsole has developed for being in contact with the arched part.

As described above, the convex part being in contact with the arch advantageously relieves shock transferred to the sole of the foot, specifically, the arch, when walking, so as to reduce foot fatigue. However, a convex shape of the convex part is uniformly mass-produced so as to form a standardized uniform structure, so that a case may occur where the arch of the sole of the foot is not well fitted to the convex part, depending on the person. Therefore, there is a disadvantage in that, as an occasion demands, the knoll rather gives bigger pressure on the arch, or it cannot properly support the arch.

Then, if the convex part cannot closely contact and support the arch, a feeling of foot fatigue is of course increased, and especially, if a user walks for long hours or is flat-footed, the convex part cannot stably support the arch. Therefore, a need for a footwear outsole capable of properly supporting the arch depending on different foot shapes has been on the rise.

Further, shock according to the contact between the ground and the footwear outsole is transferred to the brain through a rear part of the lower surface of the outsole, the heel of the foot, and the spine, so that the development of the structure that can relieve shock of the footwear outsole is also required.

DISCLOSURE OF INVENTION

Technical Problem

The present invention has been made in order to overcome the problems of the conventional footwear outsole, and an object of the present invention is to provide a footwear outsole, wherein an arch member is formed on a central part of an upper surface of a footwear outsole, and a position of the arch member of the outsole can be shifted depending on a position of an arch of a user's foot. Further, a shiftable rear heel is formed in a rear part of a lower surface of the footwear outsole. Therefore, the footwear outsole can be fitted to the shape of the user's foot so that not only can it prevent the foot from becoming flat, but also, it can reduce foot fatigue so as to maintain a comfortable wearing sensation, and bring the effect of spine correction so as to improve the function of the stature.

Technical Solution

In accordance with an aspect of the present invention, there is provided a footwear outsole which has a shape of the sole of the foot and is formed on a lower surface of uppers of the footwear, and includes an arch member shiftably assembled on a central part of a upper surface of the outsole in a longitudinal direction thereof and a rear heel shiftably assembled on a rear part of a lower surface of the outsole in a longitudinal direction thereof.

Advantageous Effects

According to the present invention, the footwear outsole includes the shiftable arch member on the upper surface of the outsole, so that the position of the arch member can be shifted to fit to the foot of a user so as to sufficiently support the arch of the user's foot. Therefore, there is an advantage in that the footwear outsole can not only prevent the foot from becoming flat, but can also minimize shock on the sole of the foot, and reduce foot fatigue.

Further, the shiftable rear heel is formed along the lower surface of the rear part of the footwear outsole, so that loss of calories and an effect of stretching are maximized so as to make the blood smoothly circulate and acupressure the acupunctural K1 region.

BRIEF DESCRIPTION OF THE DRAWINGS

The foregoing and other objects, features and advantages of the present invention will become more apparent from the following detailed description when taken in conjunction with the accompanying drawings in which.

MODE FOR THE INVENTION

Figure 1:
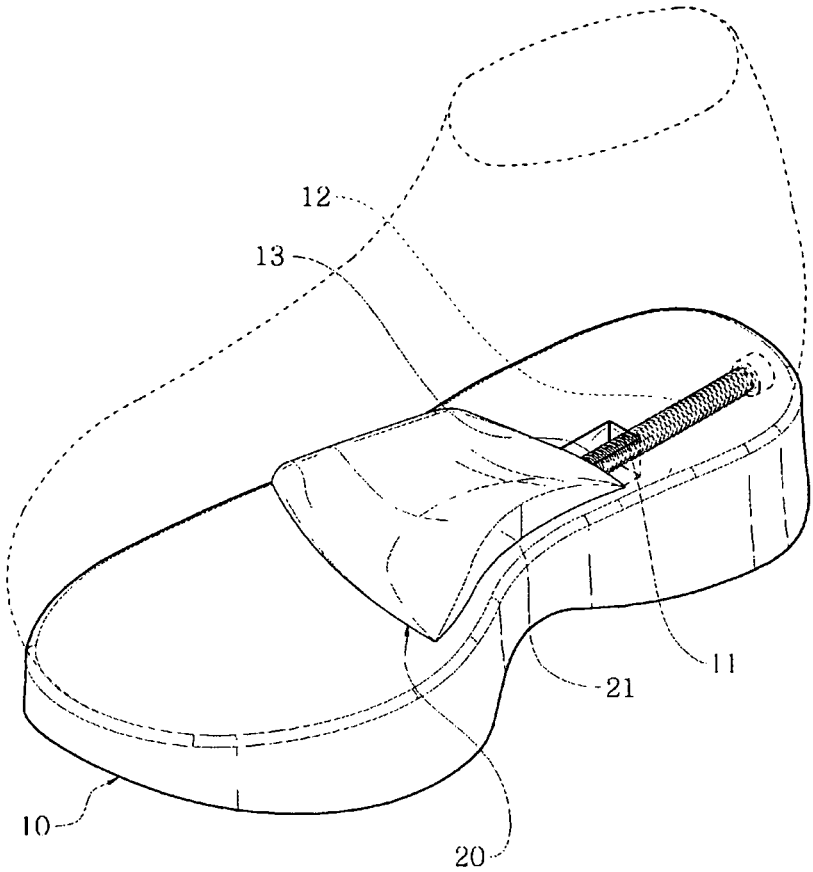
FIG. 1 is a perspective view illustrating a footwear outsole according to a first exemplary embodiment of the present invention.

The technical characteristic of a footwear outsole according to the present invention is that the footwear outsole includes a shiftable arch member on a central part of an upper surface of an outsole body in a longitudinal direction thereof, so that the position of the arch member can be controlled depending on the position of the arch of a user's foot.

The other technical characteristic of the footwear outsole according to the present invention is that the footwear outsole includes a shiftable rear heel at a rear part of a lower surface of the outsole body in the longitudinal direction thereof, so that it can not only prevent the foot from becoming flat, but can also reduce foot fatigue.

Therefore, the footwear outsole of the present invention includes the outsole body, which is formed on a lower surface of the footwear uppers so that the lower surface the footwear uppers is in contact with the ground, and the shiftable arch member formed at a central part of the upper surface of the outsole body in the longitudinal direction thereof. The detailed descriptions for the respective components are as follows.

The outsole body configures footwear through being assembled with a footwear body including the uppers on the upper surface of the outsole body. The outsole body is made of cushioning materials having a predetermined thickness, so that it plays a role of efficiently reducing foot fatigue through absorbing shock transferred from the ground upon walking or exercising.

At this time, as necessary, it is preferable that the outsole body is manufactured to add a hard material having hardness of a certain degree and well resistant to friction at the lower surface thereof, so as not to be easily worn away due to friction with the ground.

The outsole body is a part on which a user's foot is directly or indirectly located at the upper surface thereof. The outsole body can be classified into a front part at which the toes are located, a central part at which an arch of the foot is located, and a rear part at which the heel of the foot is located, along a longitudinal direction thereof.

The arch member is positioned on an upper surface of the central part of the outsole body and is shiftably assembled from a boundary of the front part and the central part to a boundary of the central part and the rear part in a longitudinal direction. The arch member is positioned in a space between the arch of a user's foot and the outsole body so as to closely contact the arch of a user's foot, so that the arch member can play a role of absorbing shock transferred to the arch.

At this time, a structure where the arch member is assembled with the outsole body can be implemented in various ways. Most basically, magic tape, a magnet, or the like is provided on a lower surface of the arch member having a shape identical to the space formed between the ground and the arch of the sole of the foot when the sole of the foot is in contact with the ground, and an assembly means, such as another magic tape, another magnet (a magnetic material), or the like, which can be separably assembled with the magic tape or the magnet, can be provided on the upper surface of the central part of the outsole body.

However, in the case of the above described structure, the assembly force between the arch member and the outsole body is decreased, so as to be easily detached through external force, disadvantageously.

Rather than the above described structure, the outsole body can be implemented in various ways where the outsole body includes a first shift groove in a longitudinal direction of the outsole body, and the arch member is assembled with the first shift groove to shift, or the like.

That is, the arch member is shifted so as to determine the center point of a pressure region according to the shape of the user's foot, specifically, the position of the arch, and then the position of the arch member is gradually shifted and fixed at the position corresponding to the center point, so that shock transferred to the arch of the user's foot can be efficiently absorbed.

Likewise, considering the wearing state of the user, the rear heel is also shifted in a frontward or backward direction so as to determine the most appropriate position, and then the rear heel is fixed at the position corresponding to the appropriate position, so that it can prevent the user's foot from becoming flat and reduce foot fatigue.

The detailed description for an object, a technical configuration, and corresponding functional effect of the present invention will be clearly understood through the following description with reference to the drawings illustrating exemplary embodiments of the present invention.

Figure 2:
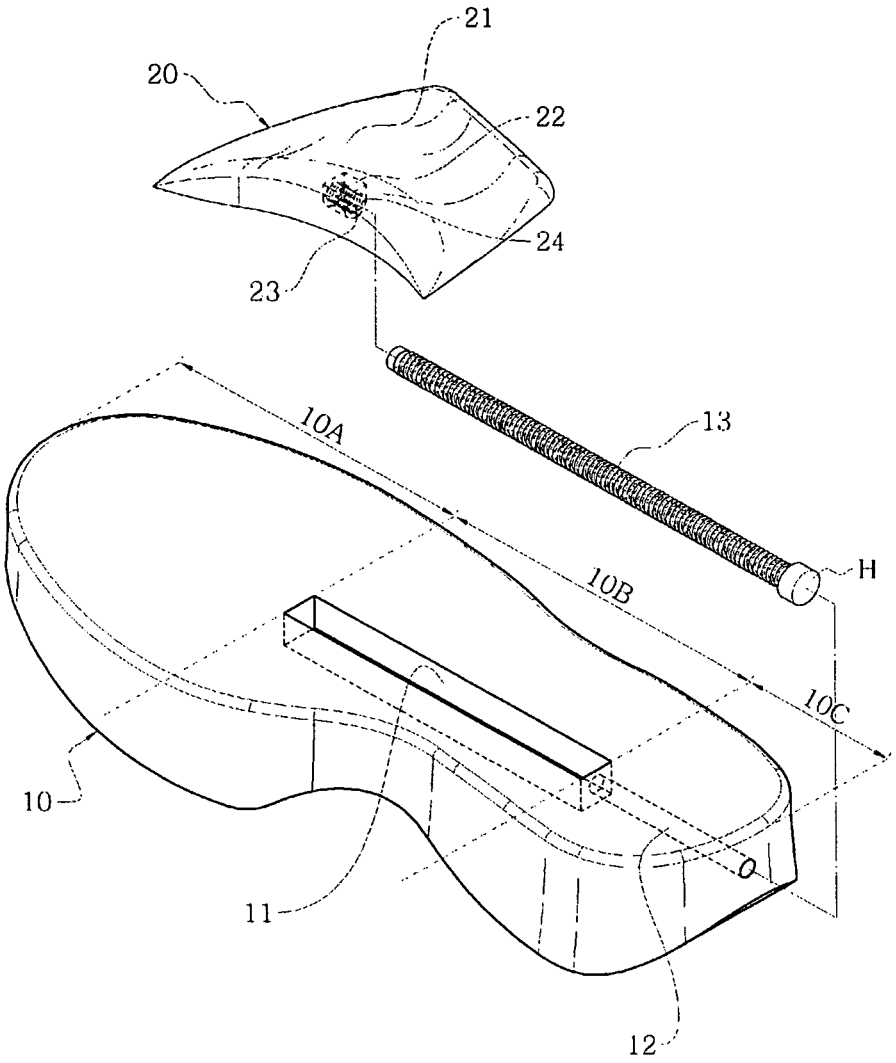
FIG. 2 is an exploded perspective view illustrating a footwear outsole according to a first exemplary embodiment of the present invention.
Figure 3:
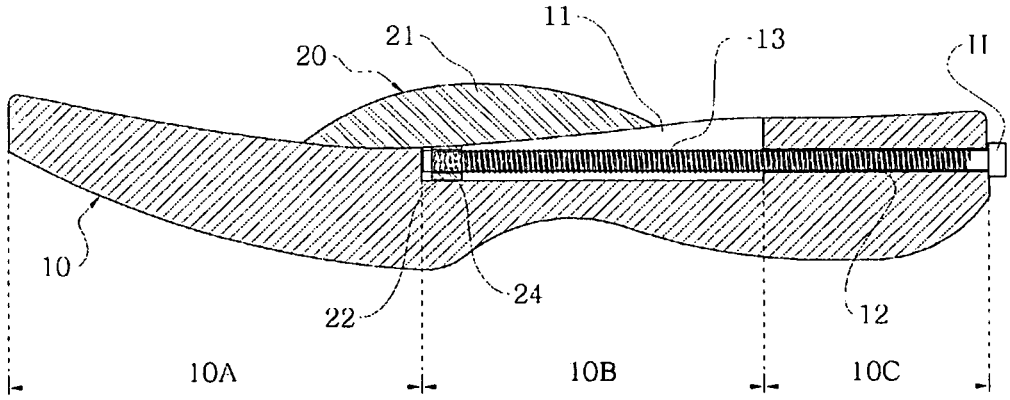
FIG. 3 is a cross-sectional view illustrating a footwear outsole according to a first exemplary embodiment of the present invention.
Figure 4:
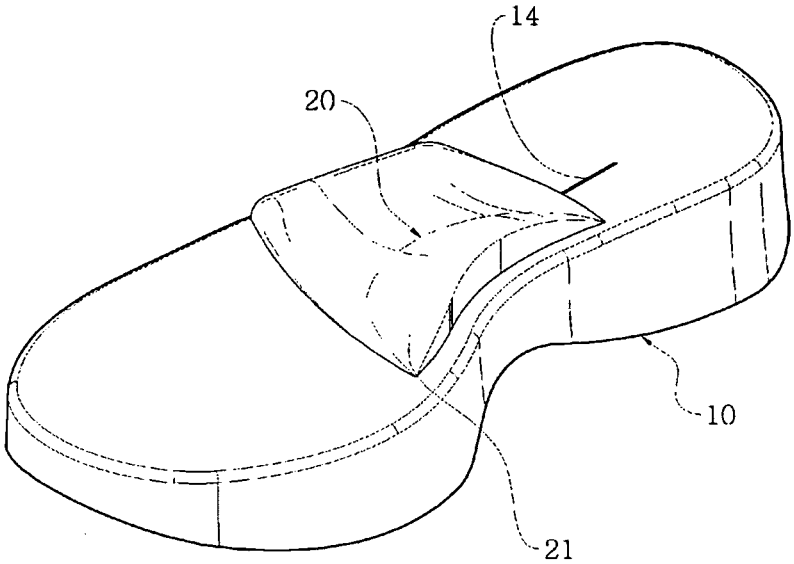
FIG. 4 is a perspective view illustrating a footwear outsole according to a second exemplary embodiment of the present invention.
Figure 5:
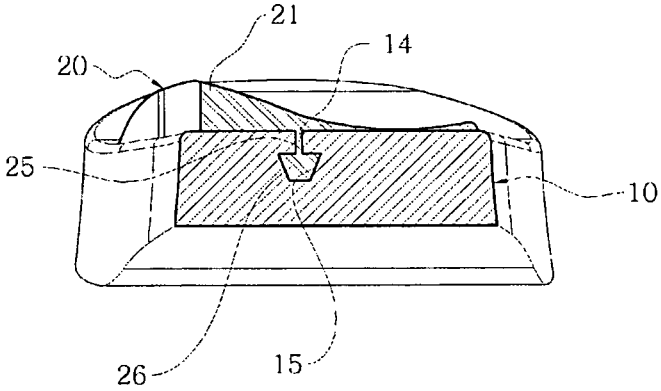
FIG. 5 is a cross-sectional view illustrating a footwear outsole according to a second exemplary embodiment of the present invention.

FIG. 1 is a perspective view illustrating the footwear outsole according to a first exemplary embodiment of the present invention, FIG. 2 is the exploded perspective view illustrating a footwear outsole according to a first exemplary embodiment of the present invention, FIG. 3 is a cross-sectional view illustrating the footwear outsole according to a first exemplary embodiment of the present invention, FIG. 4 is a perspective view illustrating the footwear outsole according to a second exemplary embodiment of the present invention, and FIG. 5 is a cross-sectional view illustrating the footwear outsole according to a second exemplary embodiment of the present invention.

Referring to FIGS. 1 to 5, the footwear outsole of the present invention includes the outsole body 10 shaped like the sole of the foot which includes: the front part 10A at which the toes of a user are located; the central part 10B at which the arch of the foot is locate; and the rear part 10C at which the heel of the foot is located, and the arch member 20 shiftably assembled on the central part 10B of the upper surface of the outsole body 10 in a longitudinal direction thereof.

At this time, the structure in which the arch member 20 is shiftably assembled with the outsole body 10 can be implemented in various ways, and an exemplary embodiment thereof is as follows.

Referring to FIGS. 2 and 3, in the outsole body 10, the first shift groove 11 is formed in a longitudinal direction along the central part of an upper surface of the outsole body, specifically, from a boundary between the front part 10A and the central part 10B to a boundary between the central part 10B and the rear part 10C in the longitudinal direction. Further, a through hole 12 longitudinally extends from a rear end of the first shift groove 11 through the rear part 10C of the outsole body 10. A first screw bar 13 shaped like a long bar is inserted through the through hole 12 up to a front end of the first shift groove 11.

Also, the arch member 20 includes a first shift supporter 22 shaped like a sectional surface of the first shift groove 11 in a longitudinal direction and protruding from a bottom surface of a convex part 21 having an arch shape, and a first through opening 23 is formed in a center of the sectional surface of the first shift supporter 22 in a longitudinal direction. The first shift supporter 22 is inserted in the first shift groove 11 while the first screw bar 13 is inserted in the first through opening 23, so that the arch member 20 can shift within the first shift groove 11 along the first screw bar 13.

A first bolt supporter 24 having a bolt shaped structure is provided in an inner circumference surface of the first through opening 23 which is in contact with a spiral-patterned protrusion formed on a surface of the first screw bar 13 in order to assemble with the spiral-patterned protrusion, so that the arch member 20 should be shifted only through the rotation of the first screw bar 13 without a need to compulsorily shift the arch member 20.

At this time, a first screw bar knob H is provided in an end of the first screw bar 13 protruding out of the rear part of the outsole body 10 in order to facilitate the easy rotation of the first screw bar 13, so that the arch member 20 should be not only easily shifted but also held at a predetermined position.

That is, in the footwear outsole having the above-described structure, if the first screw bar 13 inserted in the outsole body 10 is rotated, the first screw bar 13 and the first bolt supporter 24 having a nut and bolt structure, respectively, are engaged with each other so as to shift, so that the arch member 20 can be shifted to a predetermined position along the first shift groove 11 of the upper surface of the outsole body 10.

The above described outsole has an advantage in that one can easily control the arch member while wearing the footwear. However, the first shift groove 11 of the upper surface of the outsole includes a space, so that it is difficult to not only firmly support the foot positioned on the upper surface of the first shift groove 11, but also absorb shock. Therefore, it is preferable to minimize the width of the first shift groove 11.

Referring to FIGS. 4 and 5, the footwear outsole according to the present invention can include the outsole body 10 shaped like the sole of the foot, which includes an incision part 14 on the upper surface of the central part 10B along a longitudinal direction thereof, and a shift space 15 in a lower part of the incision part 14, and the arch member 20, which includes the convex part 21 shaped like the arch and placed on the upper surface of the outsole body 10, a shift piece 25 downwardly extending at a lower surface of the convex part 21 and interposed between the incision part 14, and a latch opening 26 extending from a lower portion of the shift piece 25 positioned in the shift space 15, and having a shape identical to that of a sectional surface of the shift space 15.

That is, the latch opening 26 of the arch member 20 is fitted to the shift space 15 of the outsole body 10, and the shift piece 25 is interposed between the incision part 14 so as to shift, so that the arch member 20 can be held in a shifted state through friction between the latch opening 26 and the shift space 15, and the friction force between the shift piece 25 and the incision part 14.

There is an advantage in the afore-mentioned structure that, through minimizing the shift space of the arch member 20, the entire of the upper surface of the outsole body 10 can support the user's foot, and an additional structure for shifting and holding the arch member 20 is not required.

At this time, a user should grasp the convex part 21 of the arch member 20 and directly shift the arch member 20 so that the shift piece 25 of the arch member 20 should have hardness in order to well resist the friction force with the footwear outsole upon shifting the arch member 20.

Referring to an additional embodiment of the outsole of the present invention having the above structure, it is preferable to have a shiftable rear heel 30 in order to not give a burden upon wearing the footwear for many hours and to prevent a side effect, when considering the body balance.

Figure 6:
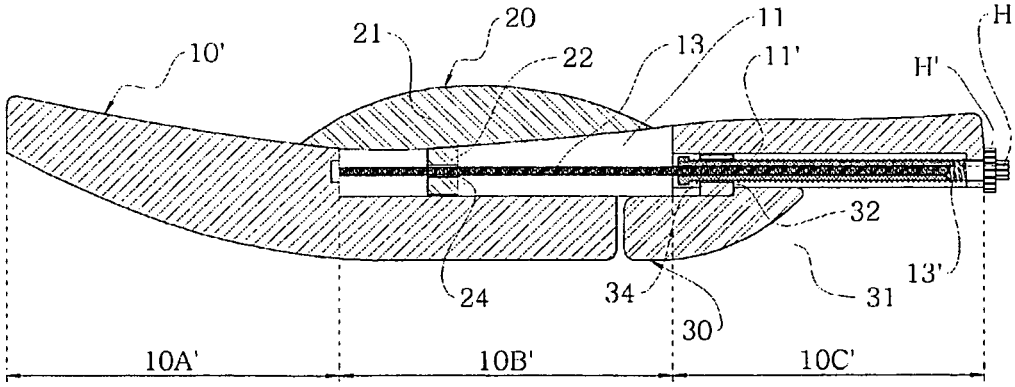
FIG. 6 is a cross-sectional view illustrating a footwear outsole according to a third exemplary embodiment of the present invention.
Figure 7:
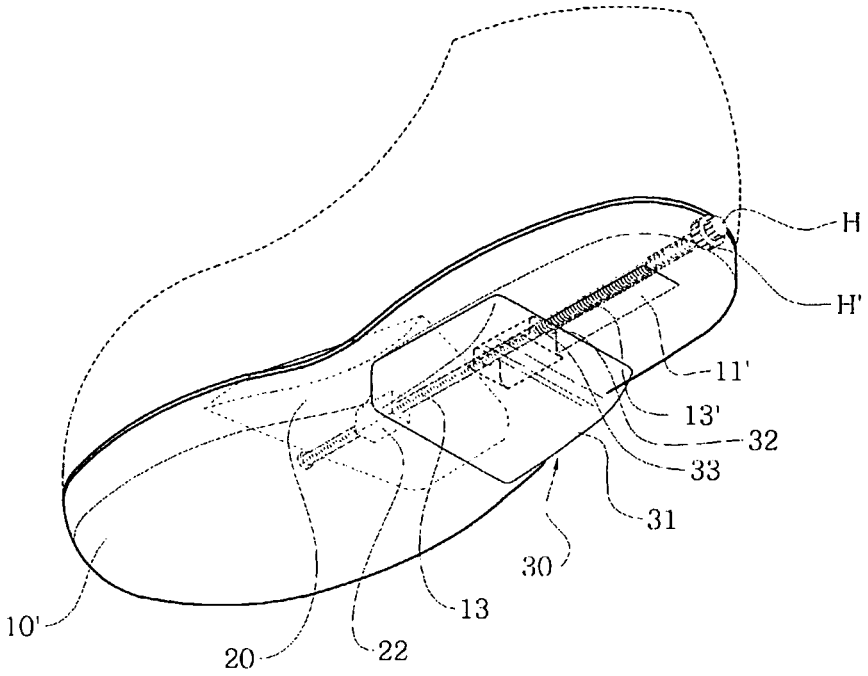
FIG. 7 is a bottom perspective view illustrating a footwear outsole according to a third exemplary embodiment of the present invention.

That is, as shown in FIGS. 6 and 7, the shiftable rear heel 30 can be provided on the rear part of the lower surface of the outsole, and a detailed description thereof is as follows.

An outsole body 10' having the shiftable rear heel 30 is divided into a front part 10A', at which a lower surface of the outsole body 10' is in contact with the ground, a central part 10B', at which a lower surface thereof is in contact with the ground and the first shift groove 11 is formed on the upper surface thereof in the longitudinal direction, and a rear part 10C', which is spaced apart from the ground by a predetermined height in order for the lower surface thereof not to be in contact with the ground and has a second shift groove 11' in the lower surface thereof.

The outsole body 10' includes the first screw bar 13 extending from the first shift groove 11 in the central part 10B' to the second shift groove in the rear part and the second screw bar 13' extending the second shift groove 11' in the rear part 10C', The second screw bar 13' has a larger diameter than that of the first screw bar 13, and is assembled in order to enclose an outer surface of the first screw bar 13. That is, the first and second screw bars 13 and 13' are concentrically formed.

The arch member 20 formed on the upper surface of the central part 10B' of the outsole body 10' includes the convex part 21 shaped like an arch and placed on the upper surface of the central part 10B' and the first through opening 23 downwardly protruding in the lower surface of the convex part 21 and is formed at the center of the sectional surface of the arch member in the longitudinal direction. The first shift supporter 22 is inserted in the first shift groove 11 while the first screw bar 13 is inserted in the first through opening 23, so that the arch member 20 can be shifted within the first shift groove 11 along the first screw bar 13.

The first bolt supporter 24 having a bolt shape structure is formed in an inner circumference surface of the first through opening 23, which is in contact with the spiral-patterned protrusion formed on a surface of the first screw bar 13, in order to be assembled with the spiral-patterned protrusion, so that the arch member 20 should be shifted only through the rotation of the first screw bar 13 without a need to compulsorily shift the arch member 20.

The rear heel 30 shiftably assembled in the lower surface of the rear part 10C' of the outsole body 10' extends from the lower surface of the central part 10B' of the outsole body 10' and is rounded off in order to have a predetermined angle with the ground, so that it should be naturally curved upon walking.

The rear heel 30 is shiftably assembled through a rear heel body 31 positioned in the lower surface of the rear part 10C' a second shift supporter 32 upwardly protruding from the upper surface of the rear heel body 31 and shiftably inserted in the second shift groove 11', a second through opening 33 formed in a center of the second shift supporter 32 in a longitudinal direction, and a second bolt supporter 34 formed in an inner circumference surface of the second through opening 33 and shiftably engaged with the second screw bar 13'.

At this time, it is preferable that the first screw bar knob H is formed at an end of one side of the first screw bar 13 protruding out of the end of the rear part of the outsole body 10 in order to facilitate easy rotation of the first screw bar 13, and a second screw bar knob H' is formed at an end of one side of the second screw bar 13' protruding out of the end of the rear part of the outsole body 10' in order to facilitate easier rotation of the second screw bar 13'.

At this time, the second screw bar knob H' protrudes to have a larger diameter than that of the first screw bar knob H, and the first and second screw bar knobs H and H' are assembled to be independently rotated.

That is, as shown in FIG. 7, the second bolt supporter 24' formed in the second shift supporter 22' of the rear heel 30 is engaged with the second screw bar 13' formed inside of the second shift groove 11' of the outsole body 10', and then the second screw bar knob H' formed at the one side of the second screw bar 13' protruding from the end of the rear part of the outsole body 10' is rotated, so that the second screw bar 13' and the second bolt supporter 24' having a structure of a bolt and nut, are engaged with each other so as to rotate. Therefore, the rear heel 30 is shifted to the predetermined position along the lower surface of the rear part of the outsole body 10'.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A footwear outsole assembled in a lower surface of uppers of footwear, comprising:

an outsole body comprising a front part at which toes are positioned, a central part at which an arch of a foot is positioned, and a rear part at which a heel of the foot is positioned; and an arch member shiftably assembled on an upper surface of the central part of the outsole body in a longitudinal direction of the outsole body, wherein the arch member is configured such that an entire lower face thereof is in contact with the outsole body, and the arch member slidably moves in a front-rear direction on the outsole body while the entire lower face is in contact with the outsole body.

2. The footwear outsole according to claim 1, wherein the outsole body comprises a first shift groove formed along a longitudinal direction of the upper surface of the central part, a through hole extending from an end of a rear part of the first shift groove through the rear part of the outsole body, and a first screw bar inserted through the first shift groove up to a through hole along a longitudinal direction of the first shift groove and the through hole, and wherein the arch member comprises a convex part, a first shift supporter downwardly protruding from a lower surface of the convex part, the first shift supporter inserted in the first shift groove, a first through opening formed on a center of a sectional surface of the first shift supporter in a longitudinal direction of the first shift supporter, and a first bolt supporter formed in an inner circumference surface of the first through opening, the first bolt supporter shiftably engaged with the first screw bar.

3. The footwear outsole according to claim 1, wherein the outsole body comprises an incision part formed on the upper surface of the central part in a longitudinal direction of the central part, and a shift space formed on a lower part of the incision part, and wherein the arch member comprises a convex part positioned on the upper surface of the outsole body, a shift piece downwardly extending from a lower surface of the convex part so as to be interposed between the incision part, and a latch opening extending from a lower surface of the shift piece so as to be positioned in the shift space, the latch opening having a shape of a sectional surface identical to that of the shift space.

4. The footwear outsole according to claim 2, wherein a first screw bar knob is formed at an end of the first screw bar protruding out of an end of the rear part of the outsole body.

5. A footwear outsole assembled in a lower surface of uppers of footwear, comprising:

an outsole body shaped like the sole of a foot, which comprises a front part at which toes are positioned, a central part at which an arch of the foot is positioned, and a rear part at which a heel of the foot is positioned; and a rear heel assembled to the outsole body so as to move in a front-rear manner on a lower face of the rear part of the outsole body, wherein the outsole body comprises the front part at which a lower surface of the front part is in contact with a ground, the central part at which a lower surface of the central part is in contact with the ground, the central part having a first shift groove on the upper surface in the longitudinal direction of the central part, the rear part which is spaced apart from the ground by a predetermined height in order for the lower surface of the rear part not to be in contact with the ground, the rear part having a second shift groove in the lower surface of the rear part, a first screw bar extending through the first shift groove in the central part up to the second shift groove in the rear part, and a second screw bar extending through the second shift groove in the rear part, the second screw bar assembled in order to enclose an outer circumference surface of the first screw bar, and wherein the rear heel comprises a rear heel body positioned in the lower surface of the rear part, a second shift supporter upwardly protruding out of an upper surface of the rear heel body, the second shift supporter shiftably inserted in the second shift groove, a second through opening formed in a center of the second shift supporter in a longitudinal direction, and a second bolt supporter formed in an inner circumference surface of the second through opening and shiftably engaged with the second screw bar.

6. The footwear outsole according to claim 5, wherein a second screw bar knob protrudes out of an end of one side of the second screw bar protruding out of the end of the rear part of the outsole body.

7. A footwear outsole assembled in a lower surface of uppers of footwear, comprising:

an outsole body, which comprises a front part at which a lower surface of the front part is in contact with a ground, a central part at which a lower surface of the central part is in contact with the ground, the central part having a first shift groove on an upper surface in the longitudinal direction of the central part, a rear part spaced apart from the ground by a predetermined height in order for the lower surface of the rear part not to be in contact with the ground, the rear part having a second shift groove in the lower surface of the rear part, a first screw bar extending through the first shift groove in the central part up to the second shift groove in the rear part, and a second screw bar extending the second shift groove in the rear part, the second screw bar assembled in order to enclose an outer circumference surface of the first screw bar;

an arch member shiftably assembled at the central part in a longitudinal direction of the central part, which comprises a convex part and placed on the upper surface of the central part, a first shift supporter downwardly protruding out of a lower surface of the convex part, the first shift supporter shiftably inserted in the first shift groove, a first through opening formed on a center of the first shift supporter in a longitudinal direction, and a first bolt supporter formed in an inner circumference surface of the first through opening and shiftably engaged with the first screw bar; and a rear heel shiftably assembled at a rear part in a longitudinal direction of the rear part, which comprises a rear heel body positioned in the lower surface of the rear part, a second shift supporter upwardly protruding out of an upper surface of the rear heel body, the second shift supporter shiftably inserted in the second shift groove, a second through opening formed in a center of the second shift supporter in a longitudinal direction, and a second bolt supporter formed in an inner circumference surface of the second through opening, the second bolt supporter shiftably engaged with the second screw bar.

8. The footwear outsole according to claim 7, wherein the second screw bar has a larger diameter than that of the first screw bar so as to enclose an outer circumference surface of the first screw bar, and the first screw bar and the first screw bar are concentrically formed.

9. The footwear outsole according to claim 7, wherein the second screw bar knob is formed at an end of one side of the second screw bar protruding out of an end of the rear part of the outsole body, and the second screw bar knob protrudes having a larger diameter than that of the first screw bar knob.

* * * * *